US006811461B2

(12) United States Patent
Maddocks et al.

(10) Patent No.: US 6,811,461 B2
(45) Date of Patent: Nov. 2, 2004

(54) ARTIFICIAL EYE WITH INTEGRALLY MOLDED EYELID

(75) Inventors: Richard Maddocks, Barrington, RI (US); Shelley M. Smith, Plymouth, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/300,084

(22) Filed: Nov. 20, 2002

(65) Prior Publication Data

US 2004/0097166 A1 May 20, 2004

(51) Int. Cl.[7] ..... A63H 3/38; A63H 3/40

(52) U.S. Cl. ..... 446/392; 446/341; 446/343

(58) Field of Search ..... 446/345, 337, 446/342, 343, 344, 346, 347, 348, 349, 389, 391, 297, 392, 301, 341, 393; 623/4.1; 434/295, 296, 297

(56) References Cited

U.S. PATENT DOCUMENTS

| | | | | | |
|---|---|---|---|---|---|
| 2,497,872 | A | * | 2/1950 | Erpf | 623/6.64 |
| 2,653,328 | A | * | 9/1953 | Anderson et al. | 623/6.64 |
| 3,846,199 | A | * | 11/1974 | Cappelli | 156/61 |
| 4,233,776 | A | | 11/1980 | Suzuki | |
| 4,393,619 | A | | 7/1983 | Murch | |
| 4,477,500 | A | * | 10/1984 | Powell | 428/16 |
| 4,511,522 | A | * | 4/1985 | Rinehart | 264/46.4 |
| 4,601,673 | A | * | 7/1986 | Nasca | 446/389 |
| 4,629,442 | A | | 12/1986 | Samo | |
| 4,642,209 | A | * | 2/1987 | Powell | 264/46.4 |
| 4,842,566 | A | * | 6/1989 | Nagao | 446/345 |
| 4,875,888 | A | | 10/1989 | Harvey | |
| 5,037,344 | A | | 8/1991 | Secrist | |
| 5,540,612 | A | * | 7/1996 | Mendez | 446/392 |
| 5,735,895 | A | * | 4/1998 | Rinehart | 623/6.56 |
| 6,500,045 | B1 | * | 12/2002 | Secrist | 446/389 |

OTHER PUBLICATIONS

"Fantasy Eyes Oval Pupil," Dydacomp, 1999 at Haidasupplies.com.

Edinburgh Imports, 1998; German Hand–blown Glasseyes with wire loops for securing.

Taxidermy Eyes by Dan Brandt, 1994–1997.

Glass Eyes, Van Dyke Supply Co., Inc., 2002.

Research Mannikins, Inc., 2001 Catalogue.

* cited by examiner

*Primary Examiner*—Jacob K. Ackun
*Assistant Examiner*—Faye Francis
(74) *Attorney, Agent, or Firm*—Michael Best & Friedrich LLP

(57) ABSTRACT

An artificial eye suitable for realistic use in dolls that replicate human beings, animals, and other creatures such as dinosaurs, aliens, monsters, and the like. The artificial eyes, according to some embodiments of the present invention, have a one-piece eyeball and lid that are integrally molded. The integrally molded eye and lid of the present invention reduces the part count of the eye when compared to conventional two-piece eye/lid combinations, which lowers the cost of production by eliminating high cost, labor intensive secondary operations. Furthermore, the process used to create these high-quality artificial eyeballs is a high volume, low cost operation. Each embodiment of the present invention has one or more of the following elements: a bowl-shaped member, an eyelid integrally molded with the bowl-shaped member, a pupil visible through the bowl-shaped member, an iris-like member visible through the bowl-shaped member, and an attachment member to attach the artificial eye.

10 Claims, 2 Drawing Sheets

ARTIFICIAL EYE WITH INTEGRALLY MOLDED EYELID

FIELD OF INVENTION

This invention relates generally to artificial eyes, and more particularly to realistic artificial eyes suitable for use in dolls that replicate human beings, animals and other creatures such as dinosaurs, aliens, monsters, and the like.

BACKGROUND OF THE INVENTION

Society has seen an evolution of technology in a wide variety of industries, including the toy industry. This evolution in technology is quite apparent in several sectors of the toy industry. For example, technological enhancements have made video games more realistic and lifelike than anyone could have imagined ten years ago. Technological enhancements have also affected other sectors of the toy industry in more subtle ways. For example, board games now come with video displays on a regular basis, baseballs can measure their own velocities when thrown, and dolls can now speak, walk, and even roller skate. Many of these product enhancements have been driven by customer demand. As technology continues to improve, customers want toys that have more capabilities or that are more realistic.

One example of customer driven evolutions in the industry is found in the toys embodied as creatures, animals, dolls and various other life forms real or imagined. Dolls, despite their simplicity, have long been among the most popular toys, especially among younger children. Dolls, however, are not immune to customer demands. As such, customers have continually demanded a more lifelike doll. Therefore, dolls have become more realistic as technologies that have applications in the doll industry have evolved. As alluded to earlier, dolls now have enhanced movement and speaking capabilities that tend to make the doll seem more realistic and lifelike.

One important influence technological advancements have on the doll industry is seen in the development of dolls' eyes, which have evolved quite dramatically. Initially, dolls' eyes began as a pair of "X's" sewn on the face of the doll or as pieces of fabric sewn on the face of the doll. Then, as buttons became less expensive, buttons were used as the eyes. As technologies relating to plastics became less expensive, companies began manufacturing operations that were dedicated solely to the production of plastic eyes. True plastic eyes, opposed to buttons, began as round or oval-shaped pieces of white plastic with details such as a pupil painted on it. With advancements in clear plastics, the eyes of dolls became more realistic. One of the first developments in this field of clear plastic eyes relates to what is known as "movable eyes." Movable eyes have a clear plastic dome over a piece of white plastic to entrap a moveable piece of black plastic. The piece of black plastic trapped between the dome and the white plastic was supposed to represent a pupil. Although these moveable eyes were an advancement over the previous eyes, they were not very lifelike. Therefore, development continued towards creating more realistic, low cost eyes.

Some of the more recent developments in clear plastic doll eyes relate to hemispherical and semi-spherical shaped eyes. With regard to clear plastic eyes, many variations have developed for representing the pupil and the iris. Some conventional eyeballs have the pupil and iris painted onto a flat back surface of the hemisphere, while others use stickers or emblems instead of paint. Yet other conventional eyeballs, such as U.S. Pat. No. 4,233,776 issued to Suzuki, insert mold a piece of black plastic inside the hemisphere for the pupil and paint the iris onto the back surface of the hemisphere. Other more realistic conventional eyes are made from blown glass and have a concave surface on the backside of the hemisphere in which a pupil and an iris are painted. These types of eyes are commonly used in the taxidermy industry because of their realism. However, these eyes are not practical for use in the doll industry because they are not produced in high volumes and they are too expensive. Glass also presents a safety problem in the toy industry.

As just illustrated, technologies exist that would meet customers demands for more realistic doll eyes. However, these technologies cannot be immediately adapted to meet customer demands because of other constraints placed on the industry by customers. One of the most important constraints placed on the industry by customers is cost. Therefore, even though technologies may exist to meet customer demands, those technologies cannot be applied to this industry until they have adapted in such a way as to be more cost effective. Two factors that have direct bearing on the cost of implementing new technologies are the cost of raw products used with that technology and the quantity of finished product that the technology can produce. If a new process utilizes expensive raw products, the finished product of that product will also be expensive. Additionally, if a new process cannot produce a finished product in a high volume the finished product will be more expensive. These two cost factors tend to have a direct relationship. For example, as discussed above, very expensive eyes that have a realistic look have been developed in the taxidermy industry. These eyes, however, tend to use expensive raw products such as glass. Therefore, they are produced in low quantities.

Due to the cost constraints mentioned above, the development of the doll eye itself seems to have reached a plateau. Recent attempts to increase the realism of dolls' eyes have focused on adding additional structure around the eye such as eyelids and eyelashes. One example of an eye with eyelashes is shown in FIG. 4 of U.S. Pat. No. 4,629,442 issued to Samo. This patent is illustrative of the problems associated with separately added features, such as eyelids and eyelashes. As shown in the figure, the eyelashes are separately formed and attached to the eye through secondary operations. These secondary operations are generally expensive and labor intensive. Additionally, current processes, such as those illustrated in Samo, are relatively expensive because they require additional parts that need to manufactured, stored, and assembled. Other conventional eyes also have separately molded lids that either attach to the eye in a separate operation or that wrap around the eye. These eyes, like the eyes of Samo, are problematic because they increase the part count of the doll and the number of production operations, both of which are costly.

In light of the problems and limitations of the prior art described above, a need exists for a one-piece molded eyeball and lid that is highly adaptable to different types of dolls, that is low cost but yet produces high quality eyes, that has a reduced part count, and that can be produced in a high volume. Each embodiment of the present invention achieves one or more of these results.

SUMMARY OF THE INVENTION

The artificial eye suitable for use in creatures and dolls according to some embodiments of the present invention has a one-piece eyeball and lid that are integrally molded. The integrally molded eye and lid of the present invention reduces the part count of the eye assembly when compared to conventional two-piece eye/lid combinations, which lowers the cost of production by eliminating high cost, labor intensive secondary operations. Furthermore, the process used to create these high-quality artificial eyeballs is a high volume, low cost operation.

One embodiment of the present invention comprises a transparent bowl-shaped member, a three-dimensional border member partially surrounding and unitary with the bowl-shaped member, and an ellipsoidal member visible through the bowl-shaped member. The bowl-shaped member of this embodiment has a convex surface and a concave surface. This combination of surfaces allows the bowl-shaped member to resemble an eyeball in a more realistic manner. Also, the three-dimensional border member is geometrically similar to an eyelid. As previously mentioned, the eyelid is integrally molded with the bowl-shaped member and unitary with the bowl-shaped member. In the described embodiments, the eyelid is textured like skin to appear more realistic. Finally, the ellipsoidal member of this embodiment is intended to represent a pupil. Thus, this combination of a transparent bowl-shaped member, a three-dimensional border member, and an ellipsoidal member, provides a high-quality eye that can be produced in high volume, at a low cost, and with a reduced part count compared to conventional eyes. Furthermore, as will be discussed in greater detail below, the eye of the present invention is highly adaptable for different uses.

Some embodiments of the present invention also utilize an iris-like member adjacent the concave surface of the bowl-shaped member. This iris-like member can be either a two-dimensional figure, e.g., paint or application of an emblem, depicted on the concave surface or a three-dimensional object insert molded within the bowl-shaped member. Selection between the above two options will be determined in part by the acceptable cost of the final product and the desired look of the final product.

In other embodiments of the present invention, the ellipsoidal member can have multiple configurations. For example, much like the iris-like member, this ellipsoidal member can be a two-dimensional figure depicted on the concave surface. Depending on cost constraints, the ellipsoidal member can be a three-dimensional object insert molded within the bowl-shaped member.

In yet further embodiments, the artificial eye is provided with an attachment member to attach the artificial eye to the doll. The attachment member has a surface that mates with the eyeball and a mounting post for mounting the eye on the doll. The attachment member has an alignment member such as a mating male-female coupling that can provide proper alignment of the eye on the attachment member.

Further objects and advantages of the present invention, together with the organization and operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numeral indicate like parts.

DETAILED DESCRIPTION OF THE EMBODIMENTS

Figure 1:
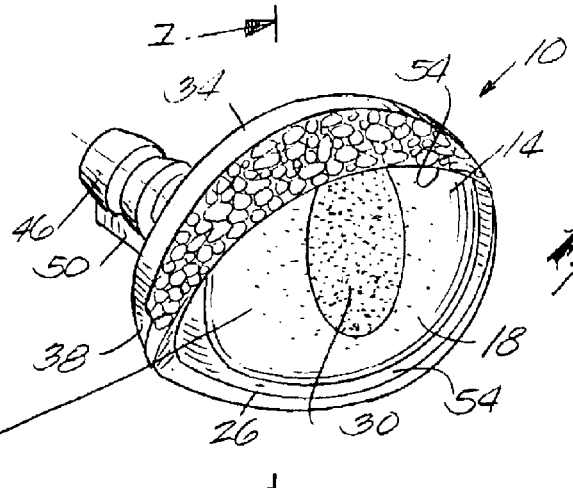
FIG. 1 is a front perspective view of one embodiment of the present invention showing the eye and the lid as an integrally molded part.

One embodiment of an artificial eye 10 suitable for use in creatures and dolls according to the present invention is illustrated in FIGS. 1–5. With reference first to FIG. 1, the artificial eye 10 includes a bowl-shaped member 14, a three-dimensional border member 26 partially surrounding and unitary with the bowl-shaped member 14, and an pupil member 30 adjacent the bowl-shaped member 14.

Figure 2:
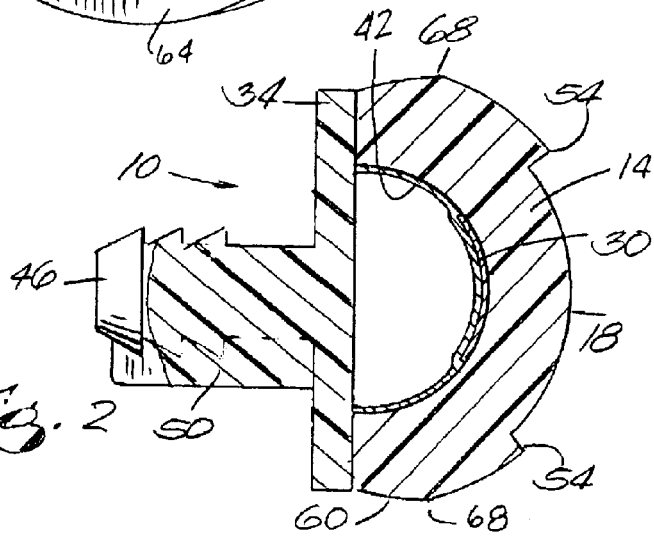
FIG. 2 is a cross-sectional view of one embodiment of the present invention showing the integrally molded eye and lid as well as various portions of the eye such as a concave portion, a convex portion, and a tapered portion.

As shown in FIGS. 1 and 2, the bowl-shaped member 14 represents an eyeball. In particular, the bowl-shaped member 14 represents, at least in part, the cornea of an eye. This bowl-shaped member 14 is preferably made out of plastic, resin, or the like. However, one skilled in the art would understand that the bowl-shaped member 14 could be made out of many other materials such as glass. Regardless of the type of material used, the described embodiments utilize low cost, transparent polymer, plastic or resin materials. These products are preferred because they produce high quality eyes, at a low cost, and in a sufficient volume. The described embodiments utilize a transparent material for the bowl-shaped member 14 because various items, such as a pupil member 30 and an iris-like member 42, can be painted or positioned within the bowl-shaped member 14 or behind the bowl-shaped member 14 to provide a realistic appearance. Furthermore, although, as discussed herein, the bowl-shaped member 14 is transparent, it does not necessarily have to be transparent. Rather, the bowl-shaped member 14 can be transparent, translucent, opaque, or any combination of part transparent, part translucent, or part opaque. The back surface, behind the bowl-shaped member, provides a concave surface 22 therein that is painted along the entire back surface with an opaque paint.

As shown in FIG. 2, the bowl-shaped member 14 has semi-spherical shape including a convex surface 18 and the concave surface 22. Since objects that replicate a pupil member 30 or iris-like member 42 can be placed in, on, or adjacent to the concave surface 22 of the eye 10, the eye 10 appears more realistic and lifelike because it replicates the arrangement of an actual eye. As will be discussed in greater detail below, in some embodiments, the pupil member 30 and the iris-like member 42 are placed adjacent to the concave surface 22 to provide a low cost, yet realistic look. While in the described embodiments, the pupil member 30 and the iris-like member 42 are insert molded adjacent to the concave surface 22 to provide a more realistic look. Various other embodiments are possible wherein the iris-like member 42 is insert molded and the pupil member 30 placed adjacent to the concave surface 22, or vice versa. Each arrangement has certain inherent advantages and disadvantages regarding cost and appearance.

As discussed above, the use of a sphere with a concave surface 22 tends to provide a realistic appearance. This, however, is not the only reason why such a configuration is used. A semi-spherical bowl-shaped member 14 with convex and concave surfaces 18, 22 can also produce significant cost savings with regard to materials. Specifically, a mold of a semi-spherical shape requires less materials than a mold of a complete sphere of the same size. Furthermore, a mold of a semi-spherical shape with a concave surface requires less material than a mold of a truncated sphere. Thus, the described embodiments utilize a semi-spherical bowl-shaped member 14 having a concave surface 22 to reduce material costs. If one is not concerned about cost, though, other configurations of the bowl-shaped member 14 are possible. As previously discussed, other configurations can include an entire sphere, a truncated sphere, and the like. Additionally, although the above discussion relates to spherical bowl-shaped members, the bowl-shaped member 14 can have other shapes such as an oval shape, an ellipsoidal shape, a rotund shape, and the like. These and all other modifications of the bowl-shaped member 14 are within the spirit and scope of the present invention.

As stated above, some embodiments preferably have at least one three-dimensional border member 26 partially surrounding and unitary with the bowl-shaped member 14. This three-dimensional border member 26 is geometrically similar to an eyelid or, as shown in FIG. 1, a pair of eyelids. Although a pair of eyelids is shown in this figure and various other figures, it is not necessary that all embodiments have two eyelids. Rather, depending on the look desired, the eye 10 could be provided with only one eyelid or a portion thereof.

The border member 26, as shown in FIG. 1, is integrally molded with the bowl-shaped member 14. Since the border member 26 is integrally molded with the bowl-shaped member 14, preferably both members are molded from the same materials. In the described embodiments, the border member 26 is advantageously molded with a skin-like texture to provide an even more realistic appearance. The border member 26 is distinguished from the bowl-shaped member 14 through low cost secondary operations, such as painting and the like. The border member 26 is preferably painted to match the skin of the doll. By integrally molding the border member 26 with the eye 10, significant cost savings can be achieved because expensive, labor intensive secondary manufacturing operations can be eliminated. Furthermore, the part count of the eye 10 can be reduced, which can also lead to additional cost savings.

The border member 26 can take any desired shape. However, in the described embodiments, the edges 54 of the border member 26 begin somewhere near the pupil member 30 and/or the iris-like member 42. Furthermore, as best seen in FIG. 2, the border member 26 edges 54 protrude in the radial direction further than the bowl-shaped member 14. As the border member 26 wraps around the bowl-shaped member 14, its circumference initially increases as one moves away from the edges 54 of the border member 26. However, after a certain distance, the circumference begins to taper (as indicated by reference number 60) and continues to taper all the way to the rear surface 64 of the eye 10. The amount of the border member 26 prior to the taper is determined based on the amount that the eye 10 will protrude from the doll. Eyes that protrude relatively little will begin to taper much sooner than eyes that protrude more. The tapered portion 60 of the eye 10 advantageously allows a portion of the eye 10 to be countersunk into the doll when it is mounted. More particularly, the entire tapered portion 60 of the eye 10 (i.e. the area from the rear surface 64 of the eye 10 up to the area of greatest circumference 68 of the eye 10) is countersunk to provide a more realistic look.

As mentioned above and shown in FIGS. 1, 3A, 3B, 3C, and 4, the embodiments also have an pupil member 30 painted or positioned within the transparent bowl-shaped member 14. This pupil member 30 is provided to represent the pupil of an eyeball and may be ellipsoidal in shape as shown. As discussed above, the pupil member 30 is formed within the bowl-shaped member 14 or is adjacent to the bowl-shaped member 14. This arrangement gives the eye 10 a more lifelike appearance. The pupil member 30 can be a two-dimensional figure depicted on a rear surface (e.g., the concave surface 22) of the bowl-shaped member 14, such as a sticker, an emblem, paint, or the like. However, the pupil member 30 may be provided as a three-dimensional object insert molded within the bowl-shaped member 14, such as black plastic, resin, or glass. The pupil member 30 may be coupled to a member adjacent to the bowl-shaped member 14 (such as the backing member 34 discussed below) rather than being placed directly on or in the bowl-shaped member 14. Additionally, the pupil member 30 may be insert molded adjacent to the concave surface 22 of the bowl-shaped member 14. However, regardless of the type of pupil member 30 used, the pupil member 30 should look quite similar to a pupil when viewed through the bowl-shaped member 14.

Some embodiments also have an iris-like member 42 in, on, or adjacent to the bowl-shaped member 14. Although an iris-like member 42 is not necessary, it can make the eye 10 appear more realistic. The iris-like member 42, similar to the pupil member 30, can be either two-dimensional or three-dimensional. Again, a sticker, emblem, paint, or the like can represent a two-dimensional iris-like member 42 on or adjacent to a surface of the bowl-shaped member 14. However, the two-dimensional iris-like member 42 is on the inner concave surface 22 of the bowl-shaped member 14. Also, a three-dimensional iris-like member 42 can be placed within the bowl-shaped member 14 or insert molded within the bowl-shaped member 14. In other embodiments, the iris-like member 42 can be coupled to a member adjacent to the bowl-shaped member 14 (such as the backing member 34 discussed below) rather than being placed directly on or in the bowl-shaped member 14.

Figure 4:
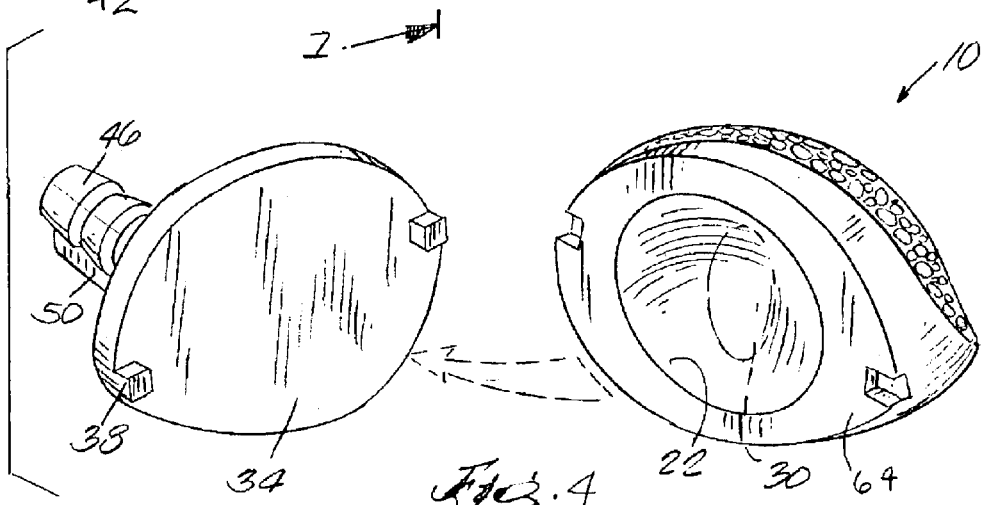
FIG. 4 is an exploded side perspective view of the embodiment presented in FIG. 1 showing the eye separated from the backing member shown in FIG. 1 to illustrate the alignment member on the backing member and the eye.

With reference to FIG. 4, the eye 10 is coupled to an attachment member or backing member 34 that is adapted to provide easier attachment to a doll. The backing member 34 has a planar front surface that is coupled to the rear surface 64 of the eye 10. The backing member 34 may be glued to the eye 10. However, it is well understood that other attaching means are available, such as an ultrasonic weld, a friction fit, a snap fit, a threaded fastener, or the like. As shown in FIG. 1, the described embodiments have an alignment member 38, such as a projection or a recess, that aligns with a mating projection or recess on the backing member 34. As the name implies, the alignment member 38 assures that the eye 10 is in proper alignment with the backing member 34. The alignment member 38 also provides a secure attachment between the eye 10 and the backing member 34 because the alignment member 38 will help resist shear and torsion forces between the eye 10 and the backing member 34. Although the alignment member 38 is not necessary in all embodiments, it is advantageous in some embodiments that use a barbed post 46 for attaching the eye 10 to a doll. Alternatively, a screw or other means to affix the post 46 in an eye socket may be provided to secure the eye 10 in the head of the creature with a screw, rivet, nail or the like received at the end of the post 46. As will be described in greater detail below, embodiments that use barbed posts 46 can also be provided with an additional alignment member 50 to make assembly and orientation of the eye 10 easier. When barbed posts 46 with alignment members 50 are utilized, proper alignment of the eye 10 on the backing member 34, through the use of an alignment member 38, may be a helpful, low-cost means to assure proper orientation of the eye 10 on the doll.

Figure 5:
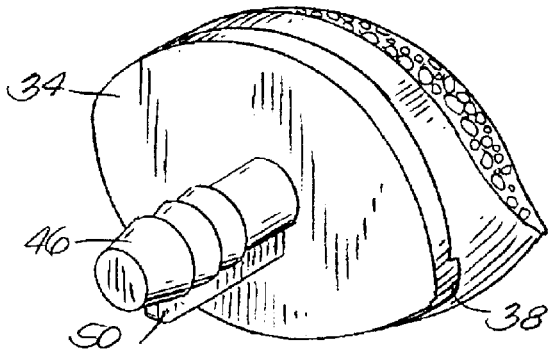
FIG. 5 is a rear perspective view of the embodiment presented in FIGS. 1, 3, and 4 showing the backing member and mounting post in greater detail.
Figure 3A:
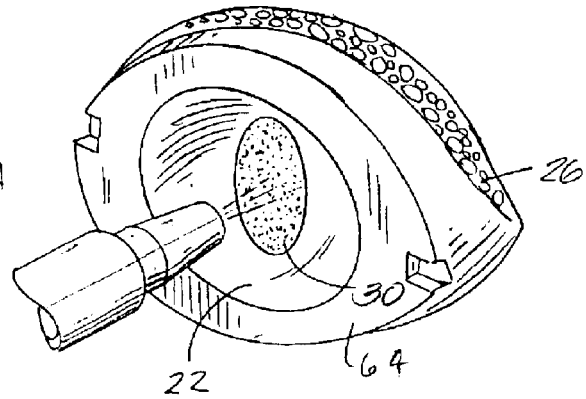
FIGS. 3A, 3B, and 3C are a rear perspective view of the embodiment presented in FIG. 1 showing secondary operations to create the pupil (FIG. 3A) and iris (FIGS. 3B and 3C) of the eye.
Figure 3B:
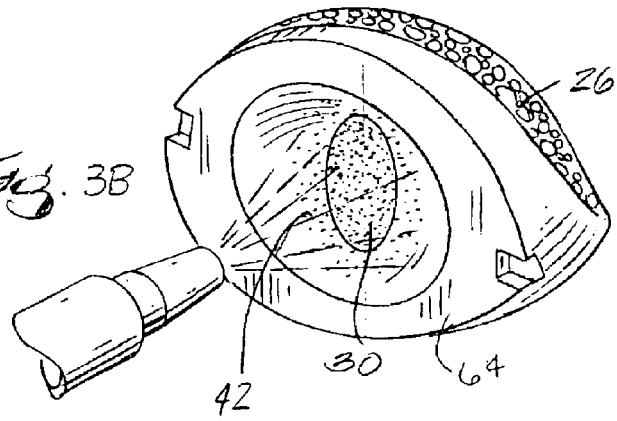
Figure 3C:
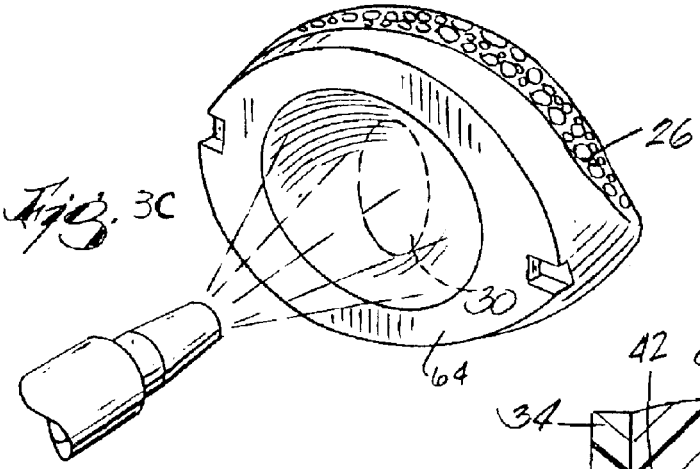

As previously mentioned, some embodiments have a post 46 attached to the backing member 34 to provide for easier attachment of the eye 10 to a doll. As shown in FIGS. 4 and 5, the post 46 is preferably barbed to help prevent detachment of the eye 10 from the doll. Highly preferred embodiments use multiple barbs on the post 46 to provide added security. The barbs help secure the eye 10 to the doll due to an interference fit. However, it is understood that other types of couplings are possible, such as a friction fit, snap fit, adhesive, a threaded fastener, or a screw as discussed above. As shown in these figures, the posts 46 may also have an alignment member 50. This alignment member 50, as previously discussed, matches with a corresponding alignment member on the doll to assure proper alignment of the eye 10 with little effort from the assembler. Proper alignment is provided by alignment of one or more corresponding projections and recesses or any other mated couplings on the post 46 and doll. When an alignment member 50 is used on the barbed post 46, it is important that the eye 10 is properly mounted and oriented on the backing member 34 for esthetics. If the eye is not properly aligned on the backing member 34, this error can not be corrected through the use of an alignment member on the post 46. Thus, the described embodiments utilize an alignment member on both the mounting post 46 and the backing member 34 to make assembly easier, more efficient and accurate, and less costly. Since the alignment members can assure proper orientation of the eye 10, less product is wasted. Besides providing proper alignment, both alignment members also help prevent rotation of the eye due to torque on the eye after it is mounted on the doll.

A method of making and assembling an embodiment of the artificial eye 10 will now be described. Assembly of the eye 10 generally begins with a molding process 10. The mold has a cavity that is somewhat bowl-shaped to produce the bowl-shaped member 14 as discussed above. Within the same cavity, the mold also has a cavity defining a three-dimensional border member 26 at least partially surrounding the bowl-shaped member 14. This border member cavity can represent one or more eyelids as described above. A high quality, low-cost plastic material is injected into a mold of the bowl-shaped member 14 to form the integrally molded eye 10 and lid 26. The integrally molded eye 10 and lid is then removed from the mold. Due to the simplicity of the mold design and the relatively low cost of the molding materials, this molding process can produce high quality, low cost eyes 10 in the volume necessary for the doll industry.

After the molding process, secondary detailing operations can be performed on the eye 10 and lid. Note that these secondary operations are low cost and are not labor intensive. Thus, the overall cost of the eye 10 is kept to a minimum as compared to other secondary operations required for conventional eyes. As discussed above, if desired, a pupil member 30 and iris-like member 42 can be added to the eye 10 at this point by any secondary detailing operation, such as painting, stamping, other customary operations, and the like. However, this step may be eliminated if the iris-like member 42 and pupil member 30 were insert molded into the eye 10 during the molding operation. Secondary operations are also used to distinguish the border member 26 from the bowl-shaped member 14. Preferably, the eyelid is painted to match the skin of the doll.

Following the detailing operations (if any are utilized), the eye 10 is then mounted on the doll. During the mounting operation it is important to make sure that the eye 10 is properly aligned before being fixed to the doll. Thus, the described embodiments utilize one or more alignment members to assure proper orientation as well as to resist movement and detachment of the eye 10 once mounted. In these embodiments, the eye 10 is first mounted on a backing member 34 that has a mounting post 46. The eye 10 preferably has a groove, slot, channel, recess, or other aperture that aligns with a corresponding land, ledge, lip, bump, or other projection on the backing member 34 that assures proper orientation of the eye 10 on the backing member 34. The alignment members on the eye and backing member are aligned and the two parts are pressed together. The eye 10 is then securely coupled to the backing member 34 via any of the methods discussed above.

The mounting post 46 on the backing member 34 is then used to secure the combined eye and backing member to the doll. For example, the mounting post 46 has several barbs for added security and an alignment member 50 to assure proper alignment of the eye 10 on the doll. The alignment member 50 is a land, ledge, lip, bump, or other projection on the post 46 that aligns with a groove, slot, channel, recess, or other aperture on the doll. The alignment member 50 on the post 46 is aligned with the proper aperture on the doll and the eye 10 is pressed in place. As discussed above, the barbs on the post form an interference fit and securely hold the eye in place on the doll. The barbs may be located at an appropriate position on the post 46 with respect to the eye socket of the doll to cause the tapered rear portion of the border member 26 to be countersunk into the eye socket.

This process as described involves fewer steps and less parts than conventional operations for creating a doll with an eyelid. By having fewer steps, less tooling and fewer workers are needed. This can lead to significant cost savings, which can ultimately reduce the final cost of the end product. Further cost savings are realized by integrally molding the eye and the lid because the eye 10 of the present embodiment utilizes fewer parts than conventional eyes. Thus, fewer parts need to be manufactured, stored, and manipulated during assembly. Most importantly, the current embodiment does not compromise quality to achieve cost savings. Rather, the quality remains high, while the costs are reduced.

It should be briefly noted that the eye of the present embodiment is highly adaptable for uses with multiple types of dolls. For example, the eyes 10 can be used in dolls that replicate human beings, animals, and other creatures such as dinosaurs, aliens, monsters, and the like. The teachings of the present embodiment apply equally to all such dolls and are not intended to be limited to any one of those uses.

The embodiments described above and illustrated in the figures are presented by way of example only, and are not intended as a limitation upon the concepts and principals of the present invention. As such, it will be appreciated by one having ordinary skill in the art that ordinary changes in the elements and their configuration and arrangement are possible without departing from the spirit and scope of the present invention. For example, other ways exist to easily and properly align the eye 10 besides those disclosed above. Any indentation, cavity, aperture, or the like in or near the eye socket can be used to properly align the eye 10 of the present embodiment if the eye 10 has a mating shape. Specifically, the socket can be distinctly shaped so that the eye can only be inserted one way—the proper way. Similarly, certain parts can have mating peripheral shapes. For example, the eye 10 and the backing member 34 can have a distinct matching profile or irregularity along their periphery to indicate proper orientation of the eye 10.

What is claimed is:

1. An artificial eye suitable for realistic use comprising:

a transparent, bowl-shaped eyeball member including:

a convex surface;

a generally planar rear surface located oppositely from the convex surface;

a concave surface substantially bounded by the rear surface;

at least one three-dimensional eyelid member partially surrounding and unitary with the bowl-shaped member;

a tapering portion extending from the eyelid member to the rear surface;

an alignment member on the rear surface;

a pupil member adjacent the concave surface and visible through the convex surface; and a backing member including a barbed mounting post and a front face for mating with the rear surface, the front face having a mating member for cooperating with the alignment member to register the alignment of the front face with the rear face.

2. The artificial eye of claim 1, wherein the front face of the backing member comprises a generally planar surface.

3. The artificial eye of claim 1, wherein the pupil member is painted in the concave surface to appear as a pupil when viewed through the convex surface.

4. The artificial eye of claim 1, wherein the pupil member comprises an ellipsoidal member visibly located at the concave surface.

5. The artificial eye of claim 4, wherein the ellipsoidal member is a two-dimensional figure adjacent the concave surface.

6. The artificial eye of claim 4, wherein the ellipsoidal member is a three-dimensional object insert molded within the eyeball member.

7. The artificial eye of claim 1, further comprising an iris-like member adjacent the concave surface.

8. The artificial eye of claim 7, wherein the iris-like member is a two-dimensional figure depicted adjacent the concave surface.

9. The artificial eye of claim 7, wherein the iris-like member is a three-dimensional object insert molded within the eyeball member.

10. The artificial eye of claim 1, wherein the eyelid member comprises a skin-like texture.

* * * * *